US006684946B2

(12) United States Patent
Gay et al.

(10) Patent No.: US 6,684,946 B2
(45) Date of Patent: Feb. 3, 2004

(54) GAS-LOCK RE-PRIME DEVICE FOR SUBMERSIBLE PUMPS AND RELATED METHODS

(75) Inventors: Farral D. Gay, Broken Arrow, OK (US); Kenneth T. Bebak, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 11 days.

(21) Appl. No.: 10/121,273

(22) Filed: Apr. 12, 2002

(65) Prior Publication Data

US 2003/0192702 A1 Oct. 16, 2003

(51) Int. Cl.[7] ..... E21B 43/00; F04D 9/02

(52) U.S. Cl. ..... 166/105; 166/68; 415/56.2; 415/56.5; 417/279

(58) Field of Search ..... 166/53, 68, 105, 166/372, 373; 415/26, 27, 56.2, 56.5, 199.2, 199.3; 417/279, 307, 424.1

(56) References Cited

U.S. PATENT DOCUMENTS

| | | | | |
|---|---|---|---|---|
| 2,553,066 A | | 5/1951 | Southern | 103/113 |
| 3,276,384 A | | 10/1966 | Boone et al. | 103/113 |
| 3,381,618 A | | 5/1968 | Napolitano | 103/113 |
| 3,425,436 A | | 2/1969 | Napolitano | 137/107 |
| 3,726,618 A | * | 4/1973 | Dicmas | 415/56.2 |
| 3,807,894 A | | 4/1974 | O'Rourke | 415/147 |
| 4,021,137 A | | 5/1977 | Zehren | 415/147 |
| 4,028,011 A | * | 6/1977 | Kramer | 417/279 |
| 4,981,175 A | | 1/1991 | Powers | |
| 5,102,297 A | * | 4/1992 | Thompson | 415/56.2 |
| 6,004,096 A | | 12/1999 | Young | 415/146 |
| 6,071,072 A | * | 6/2000 | Chang | 415/56.2 |

* cited by examiner

*Primary Examiner*—David Bagnell
*Assistant Examiner*—Brian Halford
(74) *Attorney, Agent, or Firm*—Bracewell & Patterson, L.L.P.

(57) ABSTRACT

A submersible pump assembly has a pump and a valve connected to the outlet of the pump. An outlet of the valve is connected to a riser. A valve member in the valve housing is vertically movable between a pumping position and a priming position, the valve member being biased toward the priming position. A priming conduit connects the outlet of the valve housing to the inlet of the pump for directing well fluids flowing through the conduit into an intake of the pump for re-priming the pump. When the pump is pumping well fluid, the valve member is moved to the pumping position by the fluid pressure, well fluids flowing from the inlet of the valve housing to the outlet of the valve housing but not through the priming conduit. When pumping ceases, the valve member returns to the priming position, well fluids flowing through the priming conduit for re-priming the pump.

21 Claims, 1 Drawing Sheet

GAS-LOCK RE-PRIME DEVICE FOR SUBMERSIBLE PUMPS AND RELATED METHODS

BACKGROUND OF THE INVENTION

1. Field of the Invention

This invention relates generally to electric, submersible pump assemblies and relates particularly to a pump assembly having an internal re-priming system.

2. Description of the Related Art

A conventional, electric, submersible pump (ESP) assembly includes an electric motor and a pump that is used to pump oil or other fluids within a wellbore. The electric motors have a rotatable rotor that is contained within a stationary stator. The rotors for the submersible pumps are usually disposed in substantially vertical position by virtue of their placement in wellbores, which typically are vertical shafts. Therefore, during operation, the rotor shaft of the motor is oriented in the vertical position. The motor is connected by a cable or other means to a source of electricity for powering motor.

The motor is used to operate the pump, which is typically a centrifugal pump having a plurality of stages. Each pump stage has an impeller mounted to a central shaft for rotating the impeller within a corresponding diffuser. The shaft of the motor is coupled to the shaft of the pump, and the pump stages impart an upward force to the fluid when the central shaft is rotated.

For a centrifugal pump to operate, the pump must maintain its "prime," in which fluid is located in and around the "eye," or central intake portion, of the first impeller. If gas is located in the intake, for example, if a gas slug moves through the well to the pump, the pump may lose its prime, preventing the pump from pumping while gas remains around the eye of the pump. The pump can be re-primed by moving fluids to around the intake for the first impeller, and the pump will begin operating again.

While it is known in the art to provide self-priming centrifugal pumps, many of these rely on a fluid storage chamber or reservoir to provide fluid for re-priming, for example, in U.S. Pat. Nos. 2,553,066, 3,276,384 and 3,381,618. However, it is desirable to eliminate the need for a reservoir by using the fluids in the riser to automatically actuate a valve to re-prime the pump when the pump pressure falls.

BRIEF SUMMARY OF THE INVENTION

A submersible pump assembly has a pump and a valve. The pump has an inlet and an outlet and at least one pump stage for pumping well fluids from the pump inlet to the pump outlet. The valve has an inlet, an outlet, and a valve member, the inlet of the valve being connected to the pump outlet, the outlet of the valve being connected to a conduit for conducting well fluids to a desired location. The valve member is vertically movable between a pumping position and a priming position, the valve member being biased toward the priming position. A priming conduit connects the outlet of the valve to the inlet of the pump, the priming conduit having an outlet located near the pump stage for directing well fluids flowing through the priming conduit into an intake of the pump stage.

When the pump stage is pumping well fluid, the valve member is moved by well fluid pressure to the pumping position, in which well fluids flow from the inlet of the valve to the outlet of the valve. In the pumping position, the valve member prevents well fluids from flowing into the priming conduit.

When the pump stage is not pumping well fluid, the valve member returns to the priming position, in which well fluids flow from the outlet of the valve, through the priming conduit, and into the pump inlet for priming the pump.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings.

DETAILED DESCRIPTION OF THE INVENTION

Figure 1:
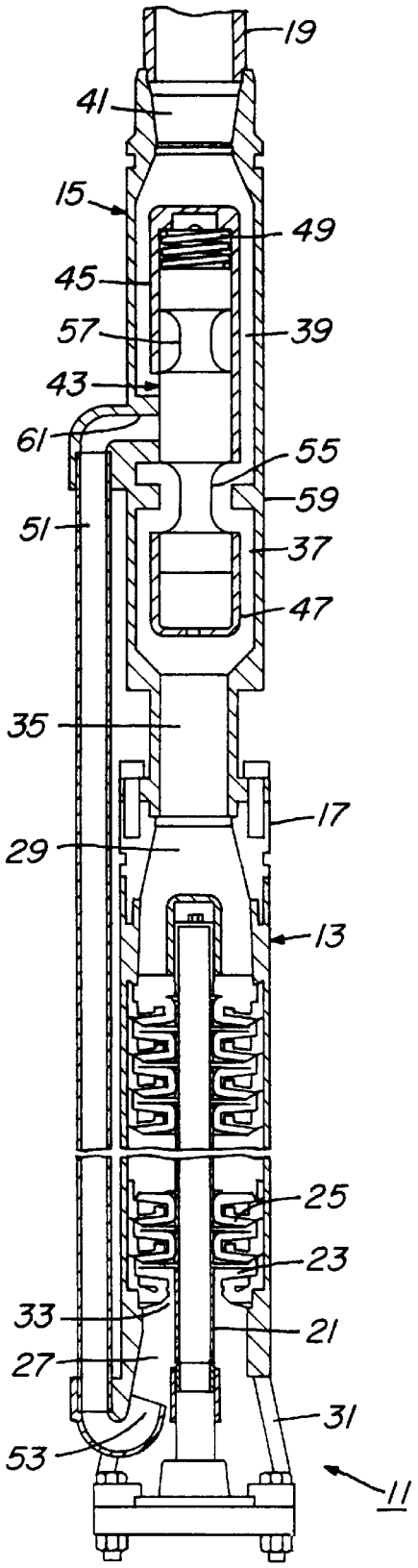
FIG. 1 is a cross-sectional view of a submersible pump and valve assembly constructed in accordance with the present invention and showing a valve member in a position during pump operation.
Figure 2:
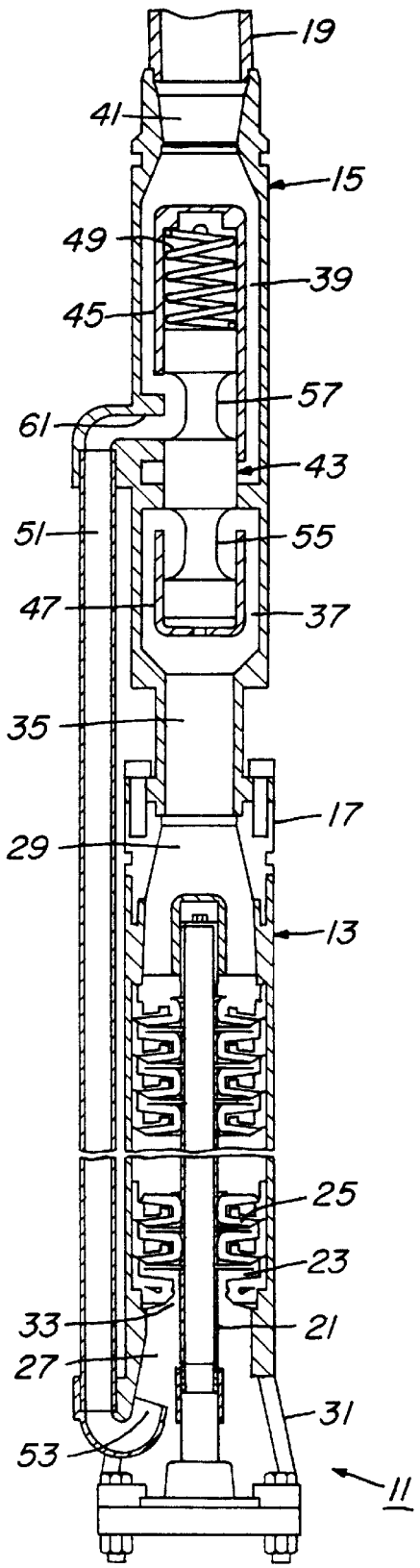
FIG. 2 is a cross-sectional view of the assembly of FIG. 1 an showing the valve member in a position allowing for re-priming of the pump.

FIGS. 1 and 2 are cross-sectional views of an upper portion of an ESP assembly 11, which comprises a submersible pump 13 and a valve 15. The upper end of pump 13 is connected to the lower end of a valve 15 at joint 17, and the upper end of valve 15 is connected to a riser 19 for conducting well fluids to a desired location. Typically, a seal section (not shown) will be connected to the lower end of pump 13, and an electric motor (not shown) is connected to the lower end of the seal section for powering pump 13.

Pump 13 is a multi-stage centrifugal pump having a central shaft 21 for rotating impellers 23 within diffusers 25. Each subsequent stage of an impeller 23 and diffuser 25 increases the pressure level of the well fluids for pumping the well fluids to a surface location. Well fluids are pumped from an annular pump inlet chamber 27 surrounding shaft 21, through impellers 23 and diffusers 25, and into a pump outlet chamber 29. Well fluids enter inlet chamber 27 through pump inlets 31 located on the lower portion of the outer surface of pump 13. Fluid is then drawn into the first impeller 23 at intake 33.

To ensure pump 13 is continuously primed, pump 13 is connected to valve 15. Valve 15 has an inlet 35 leading to a lower chamber 37 and an upper chamber 39 leading to an outlet 41. Chambers 37, 39 are separated by a valve member 43, which is located in the central portion of valve 15 and is vertically moveable between a pumping position, shown in FIG. 1, and a priming position, shown in FIG. 2. Valve member 43 is preferably formed from an elastomeric material and has an elongated cylindrical or spool shape. Valve member 43 slidingly engages the inner surfaces of an upper guide sleeve 45 and a lower guide sleeve 47, sleeves 45, 47 locating valve member 43 within valve 15 and defining the limits of travel of valve member 43. Sleeve 45 has a closed upper end and is stationarily mounted within upper chamber 39. Sleeve 47 has a closed lower end and is stationarily mounted within lower chamber 37. Sleeves 45, 47 have a smaller diameter that the inner surfaces of chambers 35, 37, creating annular areas surrounding sleeves 45, 47. A spring 49 is located above valve member 43 in upper guide sleeve 45 for biasing valve member 43 toward the priming position.

A priming conduit 51 is connected to upper chamber 39 and extends downward on the exterior of pump 13 to inlet chamber 27. Outlet 53 is located within inlet chamber 27, outlet 53 being formed to direct fluids exiting conduit 51 into intake 33 for re-priming pump 13.

Two U-shaped, horizontal, annular grooves 55, 57 are formed in the outer surface of valve member 43 and are axially spaced from each other. When valve member 43 is moved between the pumping and priming positions, grooves 55, 57 open and close selected fluid paths, controlling the flow of well fluids within valve 15. An annular seal ring 59 is located between chambers 37, 39 for sealing against the outer surface of valve member 43 when valve member 43 is in the priming position of FIG. 2. A seal 61 is located in upper chamber 39 at the opening of conduit 51, seal 61 engaging the outer surface of valve member 43 when valve member 43 is in the pumping position of FIG. 1.

Referring to FIG. 1, in the pumping position, valve member 43 is moved upward, compressing spring 49. Lower groove 55 is positioned to allow fluid to move through a production path from lower chamber 37 to upper chamber 39 through groove 55, groove 55 being approximately centered on annular ring 59. Upper groove 57 is located within guide sleeve 45. The central portion of the outer surface of valve member 43 engages seal 61, preventing fluids from flowing into priming conduit 51.

Referring to FIG. 2, in the priming position, valve member 43 is returned to the lower position. Groove 55 is moved below seal ring 59, and seal ring 59 sealingly engages the outer surface of valve member 43 to prevent fluids from moving between chambers 37, 39. Groove 57 is located so that groove 57 centers on an upper portion of seal 61 and sealingly engages a lower portion of seal 61, allowing fluids to flow in a priming path from upper chamber 39 into priming conduit 51.

In operation, when pump 13 is operating and pumping fluid, fluid is drawn into inlet chamber 27 through inlets 31. The first pump stage, comprising an impeller 23 and a diffuser 25, draws fluid into intake 33 and pumps the fluid upward into the subsequent pump stages. Each subsequent pump stage further pressurizes the fluids, the final pump stage pumping the fluids into pump outlet 29, inlet 35, and lower chamber 37. The fluid pressure acts against valve member 43, causing valve member 43 to overcome the downward force of spring 49 and move upward to the pumping position, as in FIG. 1. Fluids flow from lower chamber 37, through groove 55, and into upper chamber 39. The fluids then travel out of outlet 41 and into riser 19.

When pump 13 is not operating, or when a gas slug has moved into intake 33, the fluid pressure in lower chamber 37 is reduced. This drop in fluid pressure allows spring 49 to push valve member 43 downward to the priming position, as in FIG. 2. Valve member 43 engages seal ring 59, preventing fluids from moving from upper chamber 39 to lower chamber 37. Simultaneously, groove 57 centers on the upper portion of seal 61, allowing fluid in upper chamber 39 to flow into priming conduit 51. The fluid in riser 19 exerts hydrostatic pressure on the fluid in upper chamber 39, causing the fluid to flow downward in conduit 51 and upward out of outlet 53 toward intake 33. If pump 13 is rotating but has lost prime, the fluid is drawn into intake 33, re-priming pump 13.

Several advantages are realized with the present invention. The device provides a re-priming system for submersible pumps that is operated automatically when fluid pressure from the pump drops significantly. The device does not require a fluid reservoir or extra pumps, and the device can also be easily retrofitted to existing pump designs.

While the invention has been shown in only one of its forms, it should be apparent to those skilled in the art that it is not so limited, but is susceptible to various changes without departing from the scope of the invention.

We claim:

1. A submersible pump assembly, comprising:

at least one pump stage for pumping well fluids from a pump inlet to a pump outlet;

a valve housing having a valve inlet connected to the pump outlet, a valve outlet being adapted to be connected to a production conduit, and a valve member that is moveable within the valve housing between a pumping position, allowing flow of well fluid from the pump out of the valve outlet, and a priming position; and a priming conduit connecting the valve outlet to the pump inlet, the valve member blocking well fluid flow to the priming conduit while in the pumping position, the valve member allowing well fluid flow from the valve outlet to the priming conduit while in the priming position.

2. The assembly of claim 1, wherein:

the valve member is moved by an increase in pump pressure to the pumping position and moved by a decrease in pump pressure to the priming position.

3. The assembly of claim 1, wherein:

the valve member is biased toward the priming position.

4. The assembly of claim 1, wherein:

the valve member is biased toward the priming position by a spring.

5. The assembly of claim 1, wherein:

each pump stage is a centrifugal pump.

6. The assembly of claim 1, wherein:

the valve member has two circumferential grooves, one of the grooves completing a path from the valve inlet to the valve outlet while the valve member is in the pumping position, the other of the grooves completing a path from the valve outlet to the pump inlet while the valve member is in the priming position.

7. The assembly of claim 1, wherein:

the valve is located at an upper end of the pump.

8. The assembly of claim 1, wherein:

the valve member moves axially along a longitudinal axis of the valve housing between the pumping position and the priming position.

9. The assembly of claim 1, wherein:

the priming position is adapted to allow flow by gravity from the production conduit into the priming conduit.

10. A submersible pump assembly for pumping well fluids to a surface location, the pump assembly comprising:

a string of production conduit;

a centrifugal pump having an inlet and an outlet;

a valve housing connected between the pump outlet and the production conduit, the valve housing having a valve inlet, a valve outlet, and a priming outlet;

a valve member carried in the valve housing and axially movable in response to pump pressure from a pumping position to a priming position, the valve member being biased toward the priming position;

a priming conduit connecting the priming outlet of the valve housing to the inlet of the pump; and wherein when the pump stage is pumping well fluid, the valve member is moved by pump pressure to the pumping position, in which well fluids flow from the inlet of the valve housing to the production conduit and well fluids are prevented from flowing into the priming conduit; and when the pump stage ceases to pump well fluid at a desired rate, the valve member returns to the priming position, in which well fluids flow from the production conduit into the priming conduit and into the pump inlet for priming the pump.

11. The assembly of claim 10, wherein:

the valve member is biased toward the priming position by a spring.

12. The assembly of claim 10, wherein:

the valve member has two circumferential grooves, one of the grooves completing a path from the valve inlet to the valve outlet while the valve member is in the pumping position, the other of the grooves completing a path from the valve outlet to the pump inlet while the valve member is in the priming position.

13. The assembly of claim 10, wherein:

the valve housing comprises an upper chamber and a lower chamber, the lower chamber being connected to the valve inlet, the upper chamber being connected to the valve outlet; and the valve member has two circumferential grooves, one of the grooves completing a path from the lower chamber to the upper chamber while the valve member is in the pumping position, the other of the grooves completing a path from the upper chamber to the priming conduit while the valve member is in the priming position.

14. A submersible pump assembly for pumping well fluids, the pump assembly comprising:

a pump having an inlet and an outlet;

a valve housing connected to the pump outlet, the valve housing having upper and lower chambers separated by a partition having an orifice, a valve inlet in the lower chamber connected to the pump, a valve outlet in the upper chamber adapted to be connected to a production conduit, and a priming outlet located in the upper chamber;

a priming conduit extending from the priming outlet to the inlet of the pump;

a spool valve member having a central portion that sealingly engages the orifice;

a spring that urges the valve member to a lower position, with the central portion blocking fluid flow through the orifice and allowing flow from the upper chamber into the priming conduit; and wherein pump pressure overcomes the force exerted by the spring and pushes the valve member to an upper position, the central portion blocking the priming outlet and allowing fluid flow through the orifice from the lower chamber into the upper chamber.

15. The assembly of claim 14, further comprising:

a lower guide member located below the partition for receiving a lower end of the valve member; and an upper guide member located above the partition for receiving an upper end of the valve member.

16. The assembly of claim 14, wherein:

the pump is a centrifugal pump.

17. The assembly of claim 14, wherein:

the valve member has upper and lower circumferential grooves having a smaller diameter that the orifice, the upper groove being located above the central portion, the lower groove being located below the central portion, the lower groove completing a path from the lower chamber to the upper chamber while the valve member is in the upper position, the upper groove completing a path from the upper chamber to the priming outlet while the valve member is in the lower position.

18. A method of priming a pump of a submersible pump assembly, the method comprising:

(a) suspending a submersible pump assembly on a production conduit;

(b) pumping well fluids with the pump up the conduit;

(c) sensing the pump pressure; and (d) if the pump pressure ceases, diverting well fluid in the production conduit through a priming conduit around the pump and into a pump intake prime the pump.

19. The method of claim 18, further comprising:

blocking well fluid flow to the priming conduit when pump pressure is adequate, and allowing well fluid to flow into the priming conduit and into the pump inlet for priming the pump when pump pressure is inadequate.

20. A method of priming a pump of a submersible pump assembly, the method comprising:

(a) connecting a valve housing to an outlet of a submersible pump, the valve housing having a valve outlet connected to a production conduit and a priming outlet connected by a priming conduit to an inlet of the pump;

(b) pumping well fluids with the pump from the inlet of the pump to the valve housing, the fluid pressure moving a valve member in the valve housing to a pumping position to open a production path between the pump and the production conduit; and (c) if the pump ceases to pump fluids, moving the valve member to a priming position to close the production path and open a priming path, the priming path connecting the production conduit to the inlet of the pump via the priming conduit for priming the pump.

21. The method of claim 20, wherein:

step (c) comprises biasing the valve member toward the priming position.

* * * * *